US007370419B2

(12) United States Patent
Coffin et al.

(10) Patent No.: US 7,370,419 B2
(45) Date of Patent: May 13, 2008

(54) REPLACEMENT CARTRIDGE FOR A RAZOR ASSEMBLY

(75) Inventors: David Coffin, Hamden, CT (US); David Dombrowski, Madison, CT (US); Glennis J. Orloff, Woodbridge, CT (US); Mark S. Peyser, Easton, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 394 days.

(21) Appl. No.: 10/367,133

(22) Filed: Feb. 14, 2003

(65) Prior Publication Data

US 2003/0200659 A1 Oct. 30, 2003

Related U.S. Application Data

(63) Continuation-in-part of application No. 09/505,408, filed on Feb. 16, 2000, now Pat. No. 6,584,690.

(60) Provisional application No. 60/375,843, filed on Apr. 24, 2002.

(51) Int. Cl.
*B26B 21/44* (2006.01)

(52) U.S. Cl. ..... 30/41; 30/50

(58) Field of Classification Search ..... 30/41, 30/41.5, 50, 535, 34.2, 41.6, 51, 63, 123.3, 30/125, 538, 401; 401/195
See application file for complete search history.

(56) References Cited

U.S. PATENT DOCUMENTS

| | | | | |
|---|---|---|---|---|
| 330,418 | A | 11/1885 | Partridge et al. | |
| 951,036 | A | 3/1910 | Waterman | |
| 1,342,028 | A | 6/1920 | Nordskog | |
| 1,543,387 | A | 6/1925 | Kawalle | |
| 1,744,280 | A | 1/1930 | Peterson | |
| 1,768,307 | A | 6/1930 | Bleloch et al. | |
| 1,836,800 | A | 12/1931 | Hope | |
| 2,183,554 | A | 12/1939 | Evans | 30/84 |
| 2,614,321 | A | 10/1952 | Ackerman | |
| 2,839,224 | A | 6/1958 | Lipka | |
| 3,378,922 | A | 4/1968 | Schrader et al. | 30/66 |
| 3,477,127 | A | 11/1969 | Regan | |
| 3,488,764 | A | 1/1970 | Welsh | 30/50 |

(Continued)

FOREIGN PATENT DOCUMENTS

| | | |
|---|---|---|
| BE | 509715 | 3/1952 |

(Continued)

OTHER PUBLICATIONS

European Search Report EP 0 1300318 dated May 23, 2001.

(Continued)

*Primary Examiner*—Kenneth E. Peterson
(74) *Attorney, Agent, or Firm*—Michaud-Duffy Group LLP

(57) ABSTRACT

A replacement cartridge for a razor assembly is provided that includes a shaving aid body for use with the razor assembly. The shaving aid body includes an aperture disposed within a contact surface. The aperture is sized to receive a razor cartridge. Some embodiments of the present replacement cartridge include a base. In some of those embodiments the base includes one or more features for attaching the replacement cartridge to the razor assembly.

14 Claims, 4 Drawing Sheets

U.S. PATENT DOCUMENTS 3,675,323 A 7/1972 Braginetz ..... 30/32
3,702,026 A 11/1972 Scholin
3,703,764 A 11/1972 Perry ..... 30/32
3,703,765 A * 11/1972 Perez ..... 30/41
3,711,944 A * 1/1973 Daniels ..... 30/43.92
3,724,070 A 4/1973 Dorion, Jr. ..... 30/47
3,786,563 A 1/1974 Dorion, Jr. et al. ..... 30/50
3,832,774 A 9/1974 Perry ..... 30/32
3,871,077 A 3/1975 Nissen et al.
3,895,437 A 7/1975 DiBuono
3,925,889 A * 12/1975 Albert ..... 30/43.8
3,934,338 A 1/1976 Braginetz ..... 30/47
3,935,639 A 2/1976 Terry et al.
3,938,247 A * 2/1976 Carbonell et al. ..... 30/47
3,969,817 A * 7/1976 DiBuono ..... 30/41
3,984,027 A * 10/1976 Smith ..... 220/786
4,074,429 A 2/1978 Roberts
4,170,821 A 10/1979 Booth
4,241,500 A 12/1980 Iten
4,314,404 A 2/1982 Ruiz et al. ..... 30/41
4,336,651 A 6/1982 Caro ..... 30/49
4,389,773 A 6/1983 Nissen et al. ..... 30/50
4,407,067 A 10/1983 Trotta ..... 30/50
4,442,598 A 4/1984 Jacobson ..... 30/47
4,443,940 A 4/1984 Francis et al. ..... 30/50
4,483,068 A 11/1984 Clifford
4,534,110 A 8/1985 Glass ..... 30/346.57
4,535,537 A 8/1985 Ferraro et al. ..... 30/32
4,562,644 A 1/1986 Hitchens
4,573,266 A 3/1986 Jacobson ..... 30/41
4,586,255 A 5/1986 Jacobson ..... 30/41
4,587,729 A 5/1986 Jacobson
4,595,124 A 6/1986 Duval et al.
4,621,424 A 11/1986 Jacobson ..... 30/41
4,624,051 A 11/1986 Apprille, Jr. et al. ..... 30/50
4,712,300 A 12/1987 Hemmeter
D298,068 S 10/1988 Gilder ..... D28/47
4,778,640 A 10/1988 Braun et al.
4,807,360 A 2/1989 Cerier et al. ..... 30/49
4,850,106 A 7/1989 Braun et al.
4,875,288 A 10/1989 Trotta et al. ..... 30/49
4,893,641 A 1/1990 Strickland
4,901,437 A 2/1990 Iten ..... 30/50
4,944,090 A 7/1990 Sumnall
4,964,214 A 10/1990 Welsh et al.
4,977,670 A 12/1990 Iten
4,979,298 A 12/1990 Pesiri
4,984,365 A 1/1991 Leonard et al.
5,005,287 A 4/1991 Ritter ..... 30/41
5,031,318 A 7/1991 Brown et al.
5,036,587 A 8/1991 Trotta et al.
5,056,222 A 10/1991 Miller et al.
5,063,667 A 11/1991 Jacobson
5,063,669 A 11/1991 Althaus ..... 30/77
5,079,839 A 1/1992 Conrad, Jr. et al.
5,084,968 A 2/1992 Trotta ..... 30/47
5,121,541 A 6/1992 Patrakis
5,134,775 A 8/1992 Althaus et al.
5,141,349 A 8/1992 Maguire, Jr. et al.
5,161,307 A 11/1992 Althaus ..... 30/77
5,191,712 A 3/1993 Crook et al. ..... 30/34.2
5,249,361 A 10/1993 Apprille, Jr. et al. ..... 30/77
5,265,759 A 11/1993 Coffin ..... 221/123
5,313,706 A 5/1994 Motta et al.
5,319,852 A 6/1994 Metzger
5,347,714 A 9/1994 Prochaska
5,369,885 A * 12/1994 Ferraro ..... 30/41
5,384,961 A 1/1995 Gregory
5,430,939 A 7/1995 Johnston ..... 30/41
5,461,782 A 10/1995 Rauch
5,463,813 A 11/1995 Otsuka et al. ..... 30/43.9
5,490,329 A 2/1996 Chylinski et al.
5,493,778 A 2/1996 Ichiyanagi
5,497,550 A 3/1996 Trotta et al. ..... 30/50
5,517,760 A 5/1996 Prochaska
D373,218 S 8/1996 Shurtleff et al. ..... D28/44
5,579,580 A 12/1996 Althaus et al.
5,604,983 A * 2/1997 Simms et al. ..... 30/49
5,626,154 A 5/1997 Rogers et al.
5,666,729 A 9/1997 Ferraro ..... 30/50
5,711,076 A 1/1998 Yin et al.
D403,811 S 1/1999 Brown et al. ..... D28/47
5,903,979 A * 5/1999 Oldroyd ..... 30/41
5,956,849 A 9/1999 Chadwick et al.
D415,315 S 10/1999 Swanson et al. ..... D28/47
D416,108 S 11/1999 Shurtleff et al.
6,161,287 A 12/2000 Swanson et al.
6,185,823 B1 * 2/2001 Brown et al. ..... 30/50
6,295,734 B1 10/2001 Gilder et al. ..... 30/50
6,298,557 B1 10/2001 Gilder ..... 30/34.2
6,298,558 B1 10/2001 Tseng et al. ..... 30/41
6,308,416 B1 10/2001 Bosy et al. ..... 30/50
6,502,318 B1 1/2003 Gilder ..... 30/530
6,584,690 B2 * 7/2003 Orloff et al. ..... 30/41
6,996,908 B2 * 2/2006 Orloff et al. ..... 30/41

FOREIGN PATENT DOCUMENTS

DE 319832 2/1919
DE G 87 17 729.3 9/1989
EP 0 276 066 1/1988
EP 0276066 7/1988
EP 0 477 132 B1 3/1992
EP 0 453 906 B1 11/1992
EP 1 125 697 A1 8/2001
EP 1125697 8/2001
FR 482 302 3/1917
FR 806 899 12/1936
FR 1 503 887 12/1967
GB 409 902 5/1934
GB 1 432 182 4/1976
GB 1 572 442 7/1980
GB 2 042 959 A 10/1980
JP 4-361783 12/1992
WO WO 91/01204 2/1991
WO WO 94/11163 5/1994
WO WO 96/02369 2/1996

OTHER PUBLICATIONS

European Search Report dated Jul. 7, 2007, for EP 07107633.

* cited by examiner

REPLACEMENT CARTRIDGE FOR A RAZOR ASSEMBLY

This application is a continuation-in-part of patent application Ser. No. 09/505,408, filed on Feb. 16, 2000 now U.S. Pat. No. 6,584,690. This application claims the benefit of and incorporates by reference essential subject matter disclosed in U.S. Provisional Patent Application No. 60/375,843 filed on Apr. 24, 2002.

BACKGROUND OF THE INVENTION

1. Technical Field

This invention relates generally to shaving devices, and more specifically to replacement cartridges for razor assemblies.

2. Background Information

Modern safety razors typically include a disposable razor cartridge and a reusable handle, or a handle and cartridge combined into a unitary disposable. Most razor cartridges include a frame, one or more razor blades, and a strip of shaving aid material attached to the frame. A strip of shaving aid material typically includes one or more shaving aids (e.g., lubricating agents, drag reducing agents, depilatory agents, cleaning agents, medicinal agents, etc.) that enhance the shaving process.

The comfort and performance provided by a particular safety razor (or "razor assembly") are critical to the commercial success of the razor assembly. Improvements that benefit razor comfort, performance, and ease of use, however significant or subtle, can have a decided impact on the commercial success of a razor assembly. For example, many consumers find it desirable to shave within a wet shaving environment. Unfortunately, the water within the wet shaving environment typically removes the shaving aid before the surface can be shaved. As a result, the function performed by the shaving aid goes unexecuted. What is needed, therefore, is a device that is capable of dispensing a shaving aid material in a wet shaving environment.

SUMMARY OF THE INVENTION

It is, therefore, an object of the present invention to provide a device that is capable of dispensing a shaving aid material in a wet shaving environment, and one that, if desired, can be utilized as a replacement cartridge.

According to the present invention, a replacement cartridge for a razor assembly is provided that includes a shaving aid body that includes a contact surface and an aperture disposed in the contact surface that is sized to receive a razor cartridge. In some embodiments, the shaving aid body is coupled to a base that includes one or more features for attaching the replacement cartridge to the razor assembly.

The present invention replacement cartridge provides considerable utility when used with a razor assembly that allows the position of one or both of the blades in the razor cartridge and the contact surface of the shaving aid body to be adjusted relative to the other. Examples of such razor assemblies are disclosed in U.S. patent application Ser. Nos. 09/505,408 filed Feb. 16, 2000, 60/405,185 filed Aug. 21, 2002, and 10/367,255 filed Feb. 14, 2003, all of which are commonly assigned herewith and are hereby incorporated in their entirety by reference. The present replacement cartridge is not limited to such applications, however.

An advantage of the present invention replacement cartridge is that a device is provided that is capable of dispensing a shaving aid material in a wet shaving environment. In fact, a wet shaving environment can facilitate rather than impede the deposition of material from the shaving aid body of the present cartridge. Consequently, shaving within a wet shaving environment is not only possible, but practical as well.

Other advantages provided by the present replacement cartridge stem from the shaving aid body being a solid material that erodes during use, and distributes shaving aid material in the process. An absorbent applicator that must be filled with liquid shaving aid material prior to use, as is known in the prior art, requires additional effort by the user. It also requires that the user utilize an appropriate liquid. An inappropriate liquid accidentally loaded into the absorbent applicator could have undesirable results. An absorbent applicator in a wet shaving environment also absorbs water, and thereby likely dilutes and/or otherwise negatively effects the application of the liquid shaving aid material loaded into the applicator. Finally, an absorbent applicator consisting of a porous absorbent material will likely have an undesirable high running friction coefficient that produces unwanted drag. The present invention solid shaving aid body, in contrast, does not need to be filled before each use, provides an assurance regarding the shaving aid material, performs well in a wet shaving environment, and provides a desirable slippery surface, all of which increase the user's shave comfort.

In addition to the above-described advantages, the present invention replacement cartridge provides considerable utility when used with a razor assembly that allows the position of one or both of the blades in the razor cartridge and the contact surface of the shaving aid body to be adjusted relative to the other. During use, the contact surface of the solid shaving aid body provides a surface that can be located relative to the blades in the razor cartridge. The contact surface of the solid shaving aid body also provides a guide for the surface being shaved.

These and other objects, features, and advantages of the present invention will become apparent in light of the detailed description of the present invention.

DETAILED DESCRIPTION OF THE INVENTION

Figure 1:
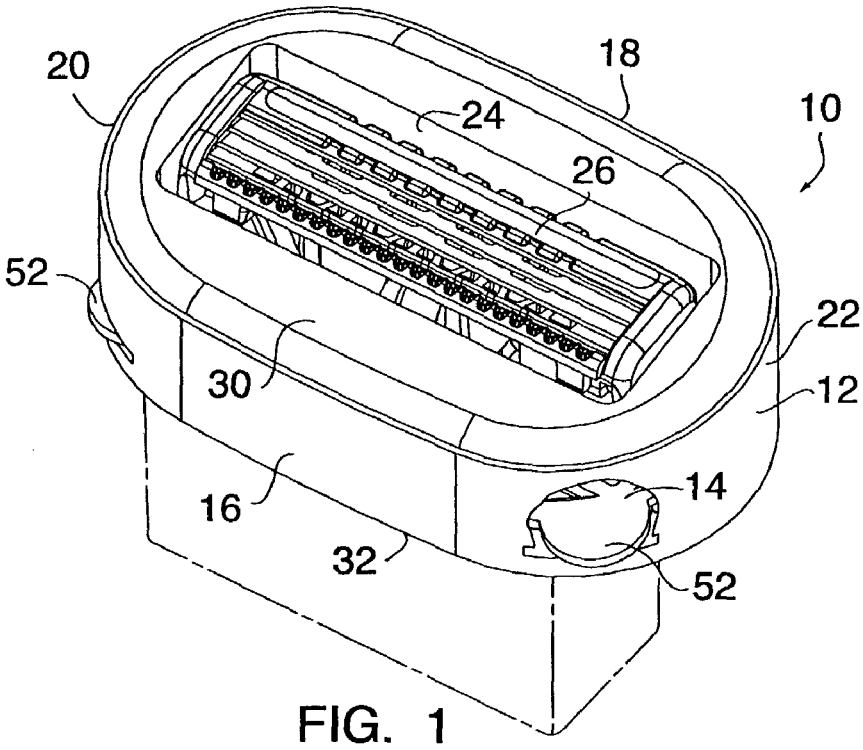
FIG. 1 is a perspective view of a replacement cartridge including a present invention shaving aid cartridge.
Figure 2:
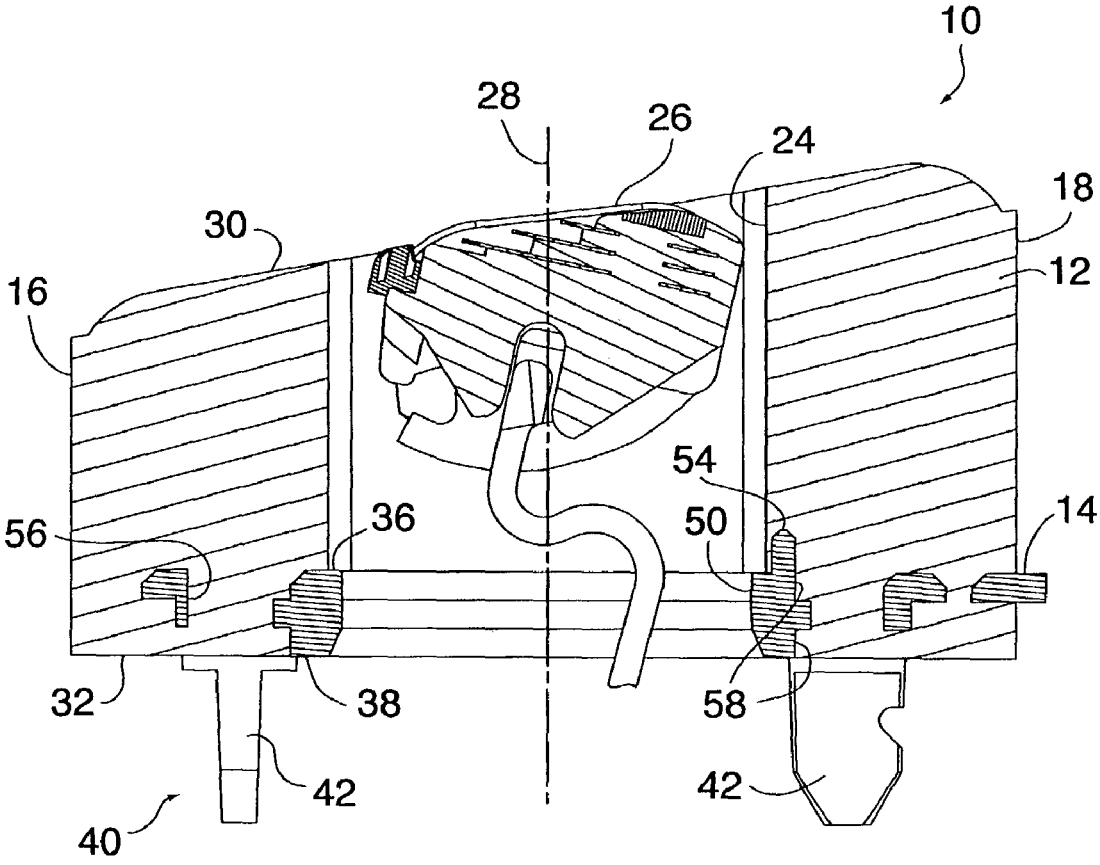
FIG. 2 is a diagrammatic cross-sectional view of a shaving aid cartridge showing the base embedded within the shaving aid body.
Figure 3:
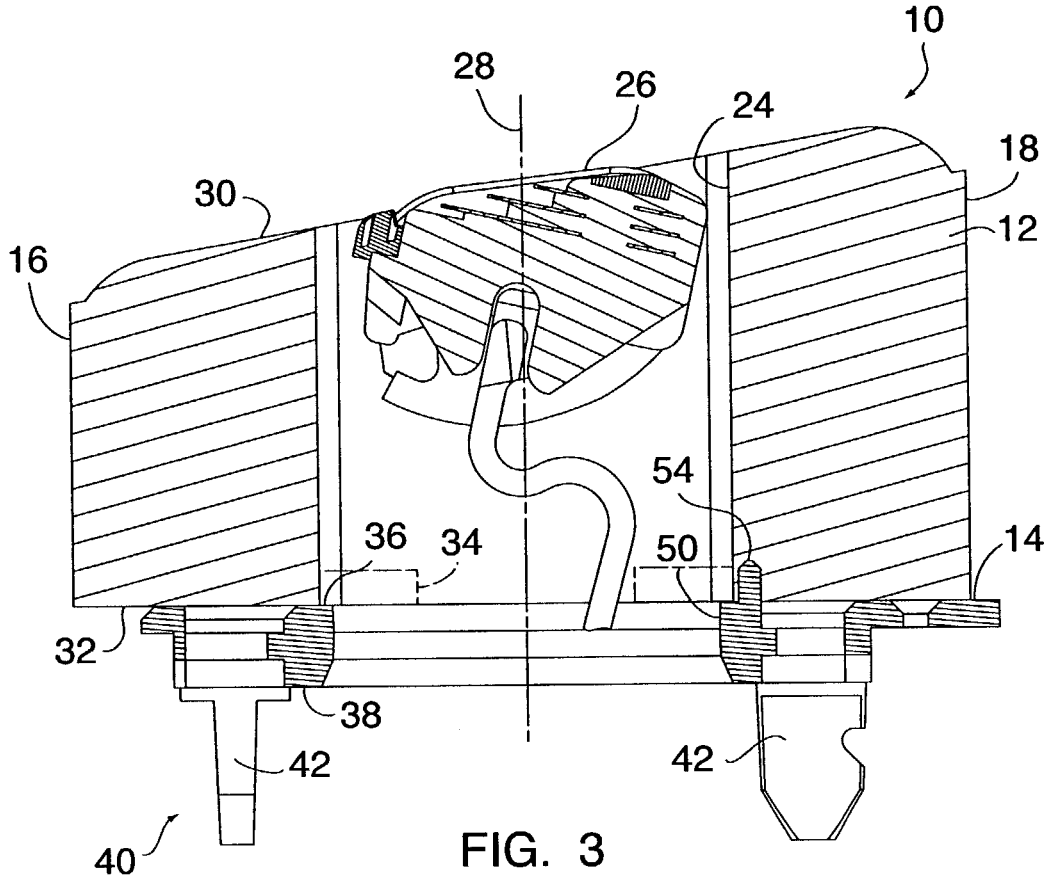
FIG. 3 is a diagrammatic cross-sectional view of a shaving aid cartridge showing the base attached to a surface of the shaving aid body.
Figure 4:
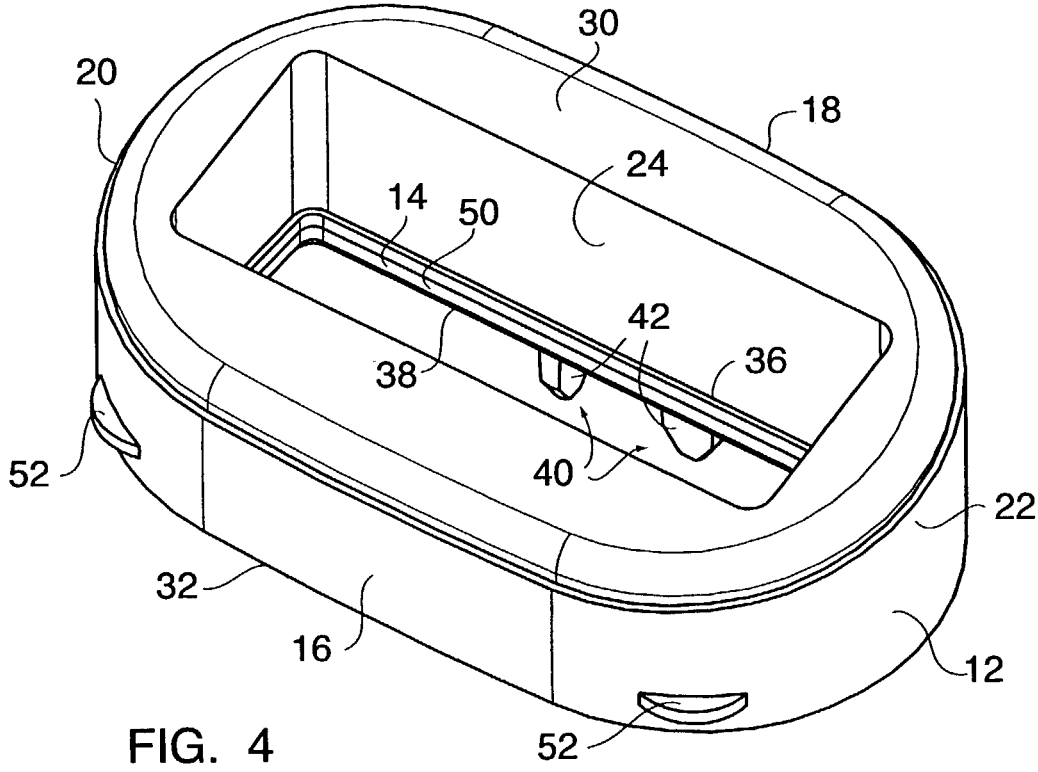
FIG. 4 is a perspective view of the shaving aid cartridge of FIG. 1 with the razor cartridge removed.
Figure 5:
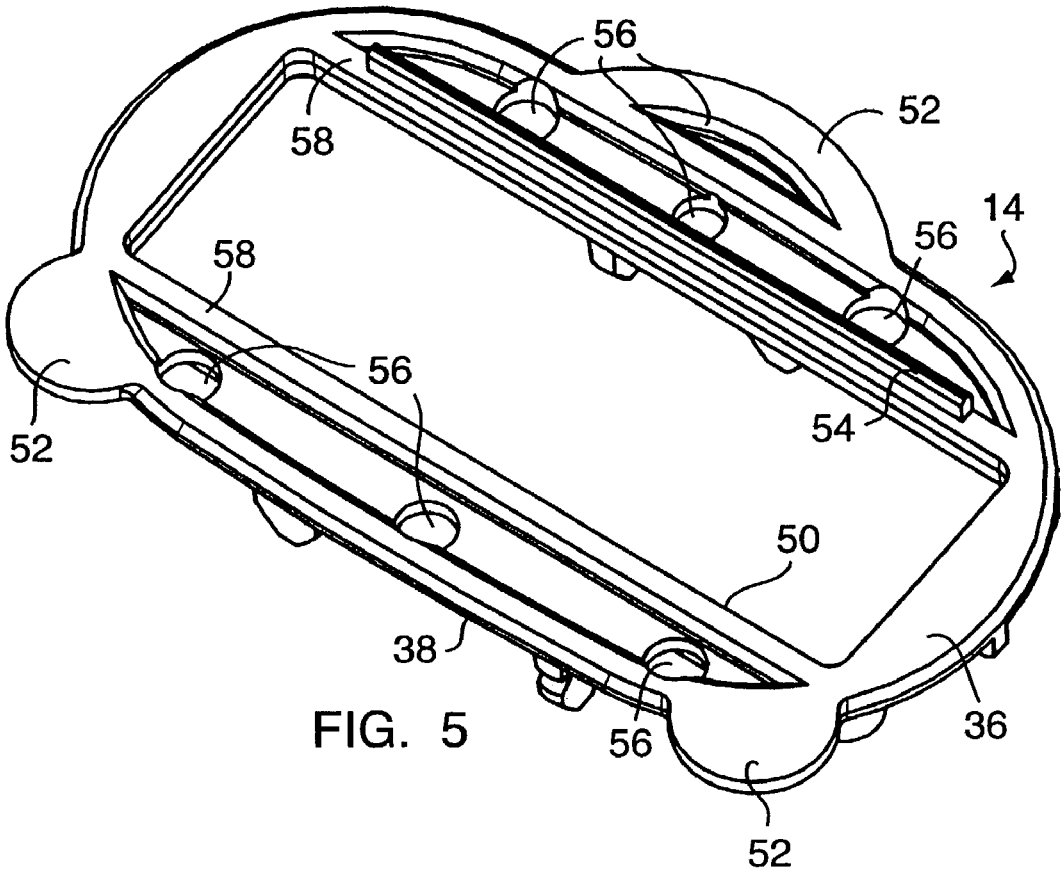
FIG. 5 is a top perspective view of a base embodiment.

Referring to FIGS. 1-4, a replacement cartridge 10 for use with a razor assembly (not shown) includes a shaving aid body 12. In the embodiment shown in FIGS. 1-4, the shaving aid body 12 is coupled to a base 14. The shaving aid body 12 has a forward portion 16, an aft portion 18, a first lateral portion 20, a second lateral portion 22, all of which are disposed around a centrally located aperture 24, which is sized to receive a razor cartridge 26. The aperture 24 may be described as having a centerline 28 (see FIGS. 2 and 3). The shaving aid body portions 16,18,20,22 extend from a contact surface 30 to a base surface 32. The aperture 24 is disposed in the contact surface 30. The aperture 24 may alternatively be described as being formed by a plurality of the shaving aid portions 16,18,20,22 positioned relative to one another in a manner that creates the centrally located aperture 24. In some embodiments, the shaving aid body 12 is one piece, having a generally oval shape. In alternative embodiments, the shaving aid body 12 may assume an alternative shape and/or may include multiple pieces; e.g., the above-described portions of the shaving aid body 12 may be separate from one another. In addition, the shaving aid body 12 may be some combination of less than all of the portions. For example, in some applications it may be desirable to have a shaving aid body 12 that includes only a pair of lateral portions 20,22 and a forward portion 22. In other applications it may be desirable to have only a single forward portion 22. The exact configuration can be varied to suit the application. In the embodiments shown in FIGS. 2-4, the aperture 24 extends between the contact surface 30 and the base surface 32. In alternative embodiments, however, the aperture 24 may not extend between the surfaces 30,32. In such instances, a second aperture 34 (example shown in phantom in FIG. 3) may be included, extending between the base surface 32 and the aperture 24. The second aperture 34 may have a different cross-sectional geometry than the aperture 24, or the same. If the second aperture 34 has the same cross-sectional geometry as the aperture 24, the aperture 24 may be described as extending between the contact surface 30 and the base surface 32.

In some embodiments, the contact surface 30 is skewed at a non-perpendicular angle relative to the aperture centerline 28. The skew angle facilitates recognition by the user of the direction the razor assembly is intended to be stroked. The magnitude of the skew angle is application dependent based upon the relationship of the contact surface 30 of the shaving aid body 12 and the position of the razor cartridge 26.

The shaving aid body 12 is an erodable solid body consisting of a shaving aid material that is selected to suit the application at hand. A soap-type shaving aid material is particularly well suited for wet shaving applications, but other shaving aid materials (e.g., lubricating agents, drag reducing agents, depilatory agents, cleaning agents, medicinal agents, sensory agents, skin stimulation agents, etc.) can be used alternatively, or some combination thereof.

In those embodiments where the replacement cartridge 10 includes only a shaving aid body 12, the base surface 32 of the shaving aid body 12 may include features (e.g., apertures) to facilitate the attachment of the shaving aid body 12 to the razor assembly.

Figure 6:
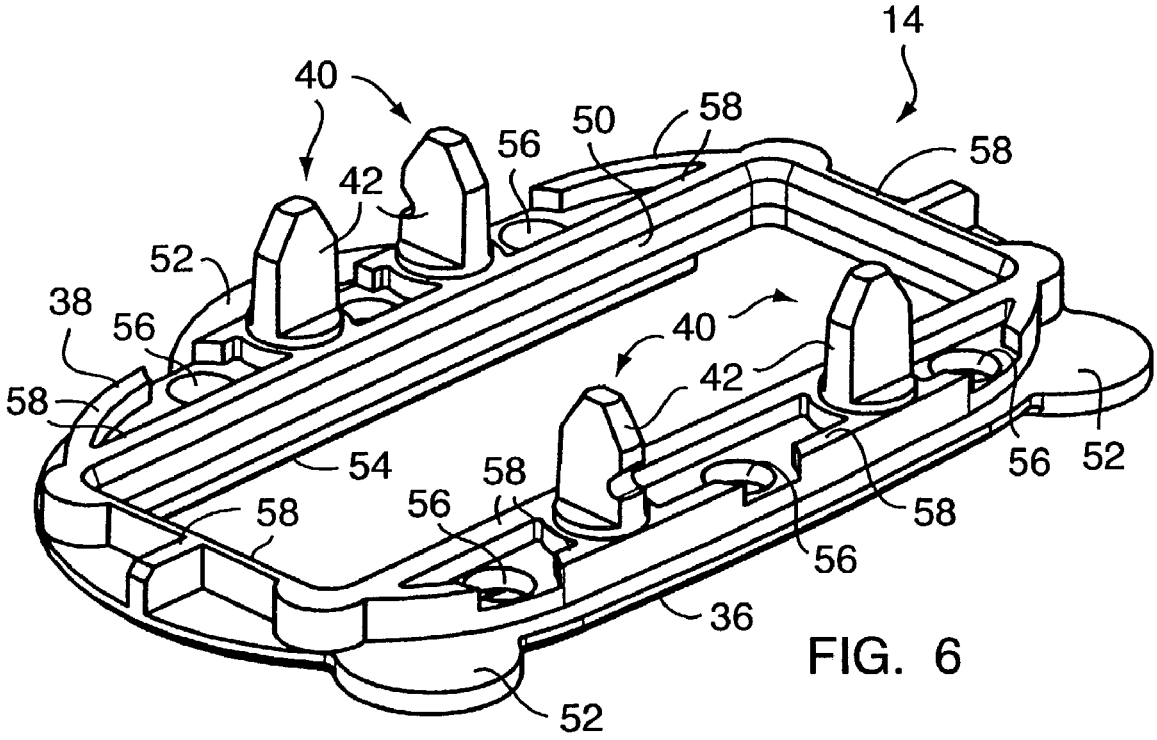
FIG. 6 is a bottom perspective view of a base embodiment.
Figure 7:
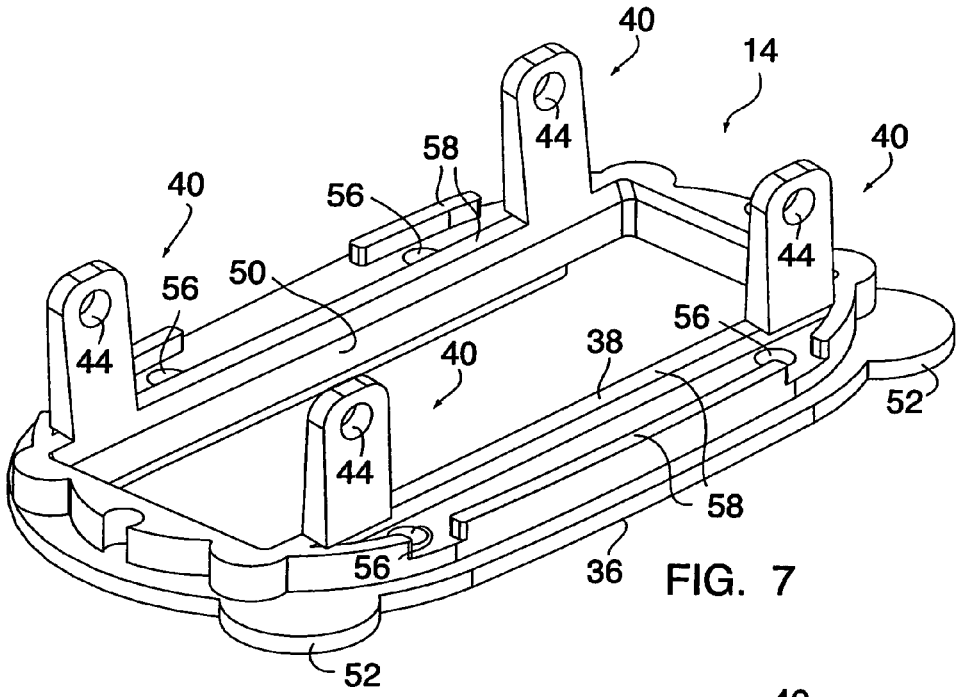
FIG. 7 is a bottom perspective view of a second base embodiment.
Figure 8:
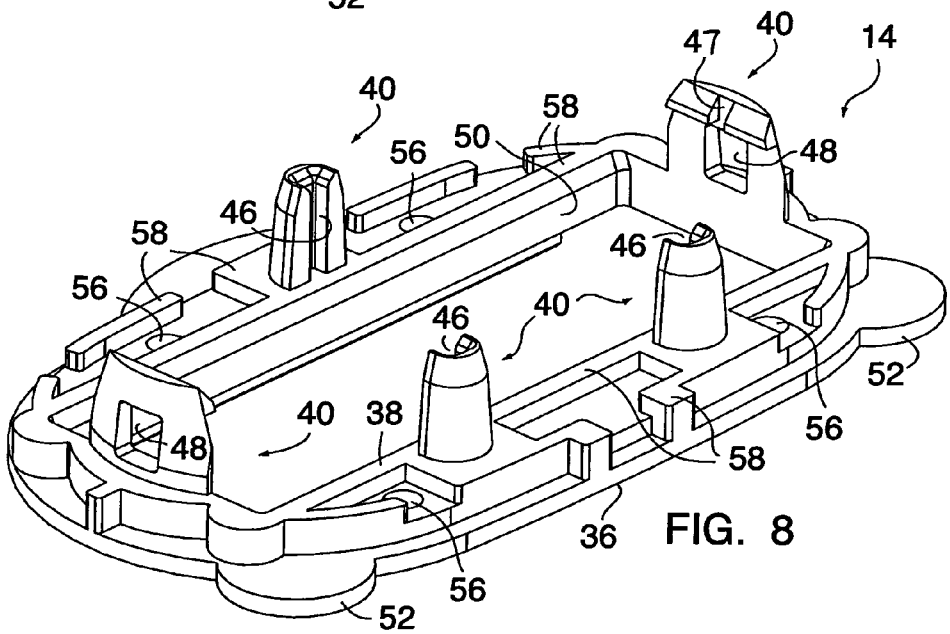
FIG. 8 is a bottom perspective view of a third base embodiment.

Now referring to FIGS. 5-8, the base 14 includes a first surface 36, a second surface 38, and one or more features 40 for attaching the replacement cartridge 10 to the razor assembly. The features 40 are preferably mechanical-type features such as tabs that extend outwardly from the second surface 38. A variety of different feature 40 configurations can be used. FIG. 6, for example, shows a plurality of notched tabs 42 extending out from the second surface 38. FIG. 7 shows a plurality of apertured tabs 44 extending out from the second surface 38. FIG. 8 shows an embodiment having two different features 40, one type of feature being a slotted tab 46 and the other type of feature being a combination of the slotted tab 46 and the apertured tab 44 of FIG. 7. In the embodiment of FIG. 8, the feature 40 that is a slotted/apertured combination includes an aperture 48 and a slot 47. The exact configuration of features 40 is selected to cooperate with the counterpart attachment mechanism of the razor assembly. Hence, the features 40 shown in FIGS. 5-8 are illustrative of the variety of mechanical features possible, but the present invention is not limited to these examples. In some embodiments, the features 40 are asymmetrically positioned on the base 14 in such a way as to provide a single orientation for proper installation of the replacement cartridge 10 on the razor assembly.

Figure 9:
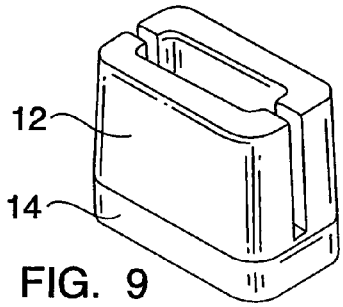
FIG. 9 is a perspective view of an embodiment of the present shaving aid cartridge.

In some embodiments, the base 14 further includes an aperture 50 that extends between the first surface 36 and second surface 38. The aperture 50 permits one or more elements (not shown) to extend between a razor cartridge disposed within the aperture 24 of the shaving aid body 12 and a mechanism attached to the razor assembly. U.S. patent application Ser. No. 09/505,408 and (Docket No. 6579-28) incorporated by reference into the present application above, disclose examples of such razor assemblies. In the embodiments shown in FIGS. 2-4, the aperture 50 is aligned with and has an axial cross-section similar to, or the same as, the aperture 24 within the shaving aid body 12. In this configuration, the razor cartridge 26 can be received within the aperture 50 of the base 14. The embodiment shown in FIG. 9, in contrast, includes a base 14 without an aperture 50 coupled with a two piece shaving aid body 12. In those embodiments that include an aperture 50, the base may include features for guiding an element within the aperture 50. Referring to FIG. 8 for example, the features 40 include slots 46 for cooperation with guide surfaces attached to an element (not shown) that is received within the aperture to guide the element within the aperture 50. Other guide arrangements may be used alternatively.

Some embodiments of the base 14 further include a plurality of tabs 52 that extend out from the base 14 in a lateral direction. The tabs 52 are used to locate the replacement cartridge 10 within packaging. Some embodiments of the base also include a rail 54 (see FIG. 5) attached to the first surface 36 of the base 14. The rail 54 facilitates high speed feeding of the base 14 through automated forming and assembly equipment and thereby aids the manufacturing process. Other features that facilitate manufacturing and/or handling of the replacement cartridge 10 may be included alternatively, or in combination therewith.

In one embodiment of the present invention, the base 14 is integrally formed with the shaving aid body 12. The term "integrally formed" as used herein refers to a base 14 that consists of one or more shaving aid materials or constituents thereof and is at least partially formed at the same time as the shaving aid body 12. The portion of the shaving aid material that forms the base 14 either initially has, or is processed to have, sufficient mechanical strength to be operable to enable attachment of the replacement cartridge 10 to the razor assembly. The appropriate process (e.g., curing, compression, etc.) used to produce sufficient mechanical strength within the integral base 14 will depend on the shaving aid material.

In some embodiments of the present invention, the base 14 is a separate member that is partially or completely embedded within the shaving aid body 12 when the shaving aid body 12 is formed. Mechanical features other than those used to directly or indirectly attach the replacement cartridge 10 to the razor assembly (i.e., features 40), are used to secure the shaving aid body 12 and base 14 together. For example, the apertures 56 disposed in, and the flanges 58 attached to, the base 14 create passages and voids in which a shaving aid material in liquid form can travel and solidify during formation. Once solidified, the mechanical strength of the shaving aid material (aided by the geometry created within the aforesaid passages and voids) is sufficient to keep the shaving aid body 12 and the embedded base 14 together.

In alternative embodiments, the base 14 is attached to, rather than being embedded in, the shaving aid body 12. The attachment can be accomplished by a variety of methods, including but not limited to mechanical means (e.g., screws, rivets, pins, barbs, etc.), adhesive (e.g., glue, etc.), or bonding (e.g., welding, etc.).

Although the present invention has been described in considerable detail with reference to certain preferred versions thereof, other versions are possible. Therefore, the spirit and scope of the invention should not be limited to the description of the preferred versions contained herein.

What is claimed is:

1. A replacement cartridge for a razor assembly, comprising:

a base;

a solid shaving aid body comprising an erodable soap-type material; and a razor cartridge;

wherein the base is at least partially embedded within the shaving aid body, wherein the base further includes one or more passages and the shaving aid body passes therethrough;

wherein the shaving aid body includes a first aperture disposed in a contact surface, wherein the first aperture is has the razor cartridge therein, such that the razor cartridge is completely encircled by the erodable soap-type material, and wherein the razor cartridge comprises a housing, a guard, a cap and at least two razor blades, all of said cutting blades having all of their cutting edges oriented in the same direction.

2. The replacement cartridge of claim 1, wherein the base includes a first surface and a second surface, and wherein the one or more features for attaching the replacement cartridge to the razor assembly include a plurality of tabs extending outwardly from the second surface.

3. The replacement cartridge of claim 2, wherein the plurality of tabs are asymmetrically arranged.

4. The replacement cartridge of claim 2, wherein the base further comprises a base aperture that extends between the first surface and the second surface.

5. The replacement cartridge of claim 4, wherein the base aperture is aligned with the first aperture disposed within the shaving body.

6. The replacement cartridge of claim 1, wherein the shaving aid body is substantially oval shaped.

7. The replacement cartridge of claim 6, wherein the contact surface is skewed relative to a centerline of the first aperture.

8. The replacement cartridge of claim 6, wherein the shaving aid body is one piece.

9. The replacement cartridge of claim 6, wherein the base includes a first surface and a second surface, and wherein the one or more features for attaching the base to the razor assembly include a plurality of tabs extending outwardly from the second surface.

10. The replacement cartridge of claim 9, wherein the plurality of tabs are asymmetrically arranged.

11. The replacement cartridge of claim 10, wherein the base further comprises a base aperture that extends between the first surface and the second surface.

12. The replacement cartridge of claim 11, wherein the base aperture is aligned with the first aperture and the second aperture disposed within the shaving body.

13. The replacement cartridge of claim 12, wherein the base aperture has an axial cross-sectional geometry substantially the same as the cross-sectional geometry of the first aperture and the second aperture.

14. The replacement cartridge of claim 13, wherein the base further comprises one or more tabs extending laterally outward.

* * * * *